US006139635A

United States Patent [19]

Mononen

[11] Patent Number: 6,139,635

[45] Date of Patent: Oct. 31, 2000

[54] BACKING BAR FOR COAT WEIGHT CONTROL SYSTEM

[75] Inventor: Helge Mononen, Richmond, Canada

[73] Assignee: Measurex Devron Inc., North Vancouver, Canada

[21] Appl. No.: 08/272,018

[22] Filed: Jul. 8, 1994

[51] Int. Cl.[7] ..... B05C 1/00

[52] U.S. Cl. ..... 118/126; 118/261; 118/413; 15/256.5

[58] Field of Search ..... 118/104, 119, 118/126, 261, 413; 101/365, 157, 169; 162/281, 336, 344, 347; 15/256.5, 156.51, 256.52; 427/359, 361; 248/223.2, 225.1

[56] References Cited

U.S. PATENT DOCUMENTS

| | | | |
|---|---|---|---|
| Re. 33,741 | 11/1991 | Boissevain | 5/238 |
| 3,378,876 | 4/1968 | Sisson | 15/256.51 |
| 3,521,602 | 7/1970 | Coghill | 118/413 |
| 3,624,860 | 12/1971 | Grimston et al. | 15/256.51 |
| 4,206,528 | 6/1980 | Klemz | 15/256.51 |
| 4,367,691 | 1/1983 | Bergs | 15/256.51 |
| 4,732,776 | 3/1988 | Boissevain | 427/10 |
| 4,768,644 | 9/1988 | Cromm | 15/256.5 |
| 4,768,645 | 9/1988 | Farris | 15/256.5 |
| 4,803,752 | 2/1989 | Kasana | 15/256.51 |
| 4,833,941 | 5/1989 | Leppanen et al. | 74/625 |
| 5,027,513 | 7/1991 | Allison, Jr. | 101/157 |
| 5,032,229 | 7/1991 | Boucher | 15/256.51 |
| 5,035,773 | 7/1991 | Hollberg et al. | 162/347 |
| 5,052,297 | 10/1991 | Albiez | 101/365 |
| 5,070,783 | 12/1991 | Ireton | 101/157 |

FOREIGN PATENT DOCUMENTS

| | | | |
|---|---|---|---|
| 2204255 | 11/1918 | United Kingdom | 118/413 |
| 9305887 | 4/1993 | WIPO | 118/126 |

OTHER PUBLICATIONS

Cross Direction Coat Weight Control by Dr. R.N. Vyse & David Carrington, pp. 1, 3 and 5, (1991).

Cross Direction Coat Weight control—Program Update by Raymond P. Shead (1991).

*Primary Examiner*—Laura Edwards

*Attorney, Agent, or Firm*—Christie, Parker & Hale, LLP

[57] ABSTRACT

A coat weight control system for applying coating to a paper sheet in a paper machine permits even coating across the sheet with less actuator force needed. The system applies a specified force profile on a coating blade and has a plurality of actuators spaced apart, the actuators each applying a load. A flexible backing bar is positioned on the coating blade having connections there along to the actuators, the backing bar having a plurality of keyhole slots between the connections, the slots spaced apart along the bar.

13 Claims, 3 Drawing Sheets

BACKING BAR FOR COAT WEIGHT CONTROL SYSTEM

TECHNICAL FIELD

The present invention relates to paper making and more specifically to a coat weight control system to reduce variation in coating across paper width. The application also finds application in a size pressed

BACKGROUND ART

One of the steps of forming paper on a paper machine is the application of a coating material to the paper surface. The coating step may be an on line or an off line operation. During the coating step, there is a need to control the weight of coating material applied to the paper substrate in both a machine and a cross direction sense. Coat weight control in the cross direction sense requires the adjustment of force on a coating blade or a coating rod to control the weight of coating on a paper sheet. Precise coating application is necessary across the width of the sheet and thus there is the need to adjust coat weight variation by changing the force on the blade and hence the position of the blade for precise coating application. In the past this has been done by the application of a plurality of actuators along the length of the coating blade that press a backing bar up against the blade. The paper sheet passes between the blade and a backing roll. Variation of the force applied to the coating blade affects the coat weight across the width of the sheet.

It is normal practice to use a solid backing bar to give a smoothly varying force application on the coating blade in a cross direction sense. In some cases an air filled pressurized flexible tube is positioned between the backing bar and the coating blade. The backing bar must have sufficient rigidity to resist the dynamic forces caused by the coating material between the blade and the paper, and yet be sufficiently flexible to allow for adequate movement to effect the cross directional coat weight application. In addition the backing bar must be substantial enough to allow attachment of actuators in a robust manner without risk of detachment from the backing bar. One problem with a solid bar is that it requires high forces to cause the required deflection for cross directional coat weight control.

One approach taken to solve this problem is the use of a segmented backing bar where each segment is attached to an adjustment point so the segments are independent of each other. However, this approach causes certain problems, for example, it is difficult to maintain a clearance between the segments and the segments tend to jam together. Furthermore, it is difficult to get a smooth deflection and force profile applied to the coating blade in a cross directional sense over a number of adjacent actuator attachment points.

A flexible bar is needed to provide a system that can easily be bent with low force actuators and still provide a smoothly changing pressure application between actuators without the problems inherent in the segmented bar approach.

SUMMARY OF THE INVENTION

It is one aim of the present invention to provide a flexible backing bar of sufficient rigidity to allow deflection with a low force actuator. In one embodiment a low force actuator provides a force not greater than 600 lbs.

The present invention provides a flexible bar as a backing bar for a coating blade, the bar having a series of keyhole slots therein permitting greater flexibility than a solid bar.

The keyhole slots have no sharp corners and thus provide a more even stress distribution than slots with sharp corners therein.

The present invention provides in a coat weight control system for applying a specified force profile on a coating blade, the improvement comprising: a flexible backing bar for applying a load to the coating blade from a plurality of actuators, the bar having a plurality of keyhole slots therein spaced between actuator locations with sufficient material in the bar for attachment of the actuators, the slots providing greater flexibility to the bar while still retaining rigidity.

In another embodiment there is provided a coat weight control system for applying a specified force profile on a coating blade comprising: a plurality of force actuators spaced apart, the actuators each applying a load, a flexible backing bar positioned on the coating blade having connections there along to the actuators, the backing bar having a plurality of keyhole slots between the connections, the slots being spaced apart along the bar.

BRIEF DESCRIPTION OF DRAWINGS

In the drawings which illustrate embodiments of the present invention.

DETAILED DESCRIPTION

Figure 1:
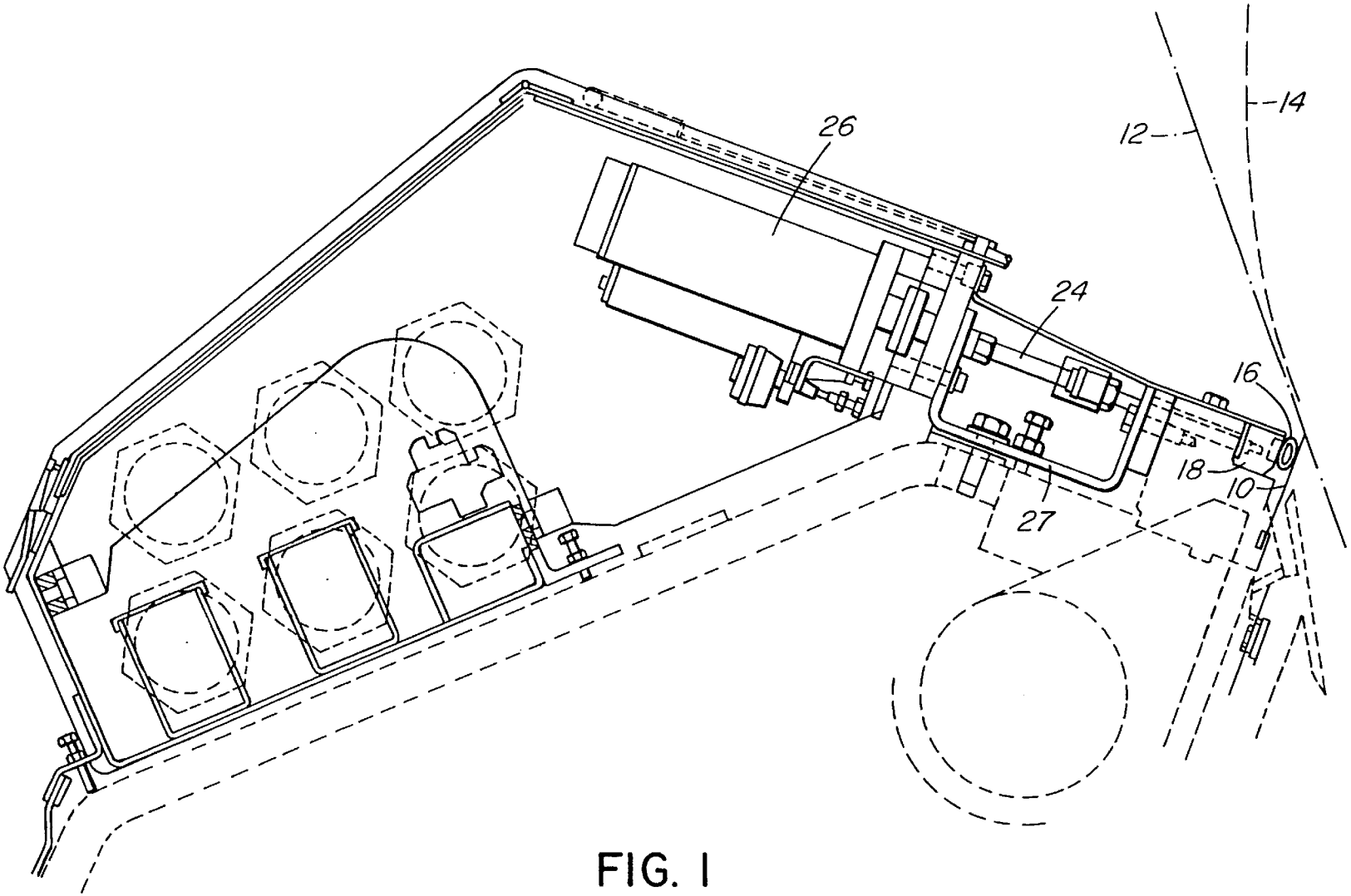
FIG. 1 is a side view showing a coating blade pressing against a sheet passing a backing roll, with an actuator and flexible backing bar provided to control the force on the coating blade.

A coating blade 10 is shown in FIG. 1 pressing against a sheet 12 moving on a backing roll 14. An inflatable tube 16 is positioned between the blade 10 and a flexible backing bar 18 and is kept pressurized.

Figure 2:
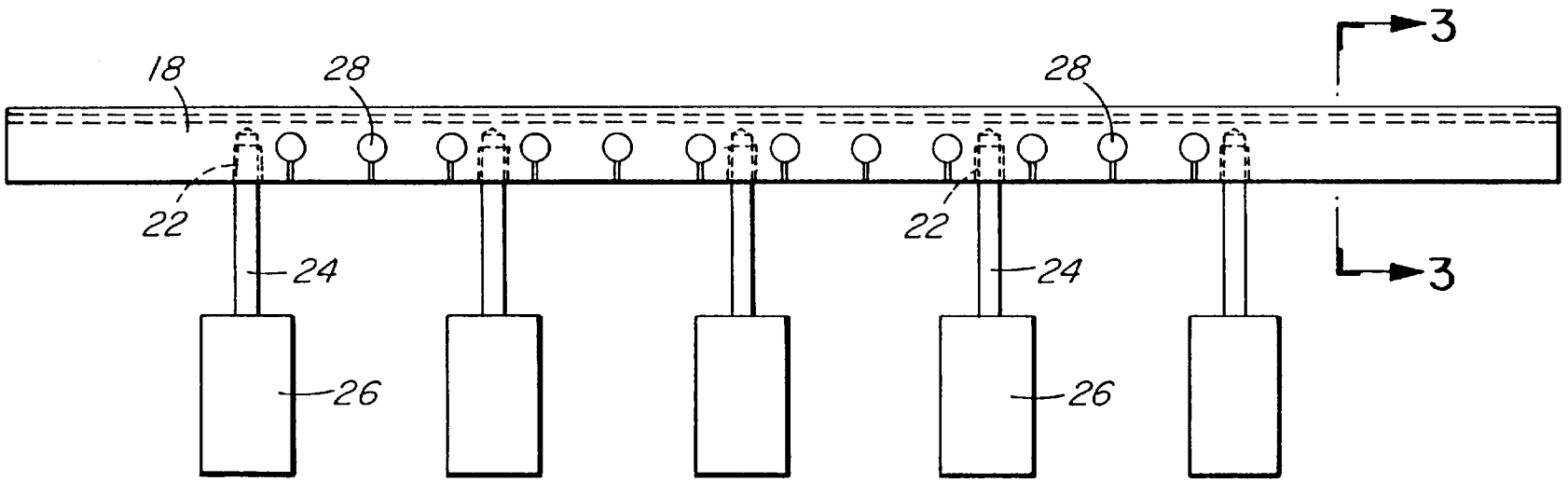
FIG. 2 is a plan view showing a flexible backing bar according to one embodiment of the invention with actuators connected thereto.
Figure 3:
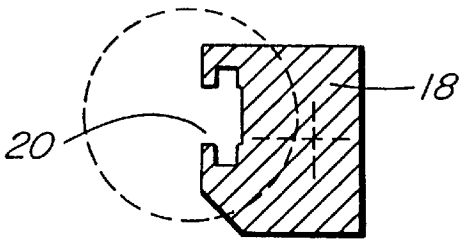
FIG. 3 is a sectional view taken along line 3—3 of FIG. 2.

Details of the flexible backing bar 18 are shown in FIGS. 2 and 3. A linear groove 20 is provided in the bar to support the tube 16 and ensure that it is retained between the blade 10 and the backing bar 18. Connection points 22 which may be in the form of tapped holes, are positioned at the back of the backing bar 18, and have rods 24 attached therein connected to actuators 26. The actuators 26 are supported on brackets 27.

Each of the actuators 26 is a low force actuator providing up to 600 lbs. force and consists of a single harmonic gear. An example of such an actuator is disclosed in U.S. Pat. No. 4,833,941.

In another embodiment, the coating blade 10 is replaced by an equivalent coating rod which performs the same function as the coating blade. A coating rod is mounted in a holder which performs in the same manner as the backing bar 18. Thus, a coating rod and coating rod holder replace the coating blade 10 and backing bar 18.

The invention is also applicable to a size press.

As shown in FIG. 2, the connections 22 are spaced apart along the length of the bar 18 and between the connections 22 are keyhole slots 28 which each comprise a circular hole in the bar with a slot in the back of the bar at the same side as the connections 22 to the actuator arms 24. The keyhole slots 28 are spaced apart at intervals along the length of the bar 18 (except at the ends) with the connections 22 having keyhole slots 28 between adjacent connections 22. The connections 22 are each positioned midway between adjacent keyhole slots 28. The keyhole slots have a rectangular portion 100 and a circular portion 102. The length of the rectangular portion, which functions as a connecting portion, extends to an edge 104 of the backing bar at one end and to the circular portion at the opposite end. The diameter of the circular portion is greater than the width of the rectangular portion. Thus, the circular portion is an opening spaced away from the edge 104 of the backing bar by the connecting portion and is kept in communication with the edge by the connecting portion, and the opening is enlarged relative to the connecting portion.

The flexible backing bar 18 with the keyhole slots 28 spaced apart along the length is made of a high yield strength and low modulus material. In a preferred embodiment the material is a high strength aircraft aluminum which provides a yield stress of at least about 72,000 psi and an elastic modulus of at least about $10.4\times10^6$ psi. This flexible backing bar 18 provides a deflection when 600 lbs. is applied by the actuator of 0.015 inches. The comparison is a stainless steel bar which is solid. This bar has a yield stress of at least about 42,000 psi and an elastic modulus of at least about $28\times10^6$ psi. The stainless steel bar provides a deflection of 0.002 inches under the 600 lbs. force. The flexible bar must retain sufficient rigidity to resist the dynamic forces caused by coating material between the blade and the paper. The keyhole slots 28 are desirable because they give more even stress distribution than other shapes and sharp corners, i.e., rectangular or square slots. The solid bar of stainless steel, within elastic limits, is too stiff to give adequate deflection with a reasonably low force but the backing rod 18 made of high strength aircraft aluminum material reduced by the keyhole slots 28 does permit the increased deflection.

Figure 4:
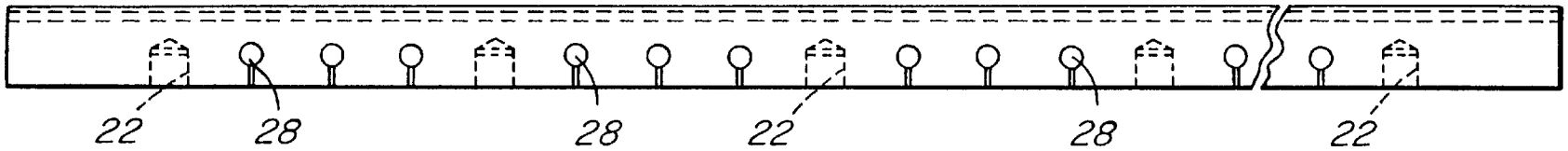
FIG. 4 is a plan view showing another embodiment of a flexible backing bar.

In another embodiment, as shown in FIG. 4, the flexible backing bar 18 is shown with a different arrangement of spaces between the connections 22 and the keyhole slots 28. As seen here, there are keyhole slots 28 spaced apart between two adjacent connections 22 and this extends for the length of the flexible bar 18. Whereas two configurations of flexible backing bar 18 have been illustrated herein, it will be apparent to those skilled in the art that other arrangements can occur, the important feature being that the flexible backing bar 18 provides a specified force profile along its length to ensure the coat weight follows the specified profile for the width of the sheet 12 passing between the coating blade 10 and the backing roll 14. The specified force profile may not always be constant for the cross direction width of the sheet 12, but is arranged to comply with a specific profile dependent upon various parameters of the machine.

Figure 5:
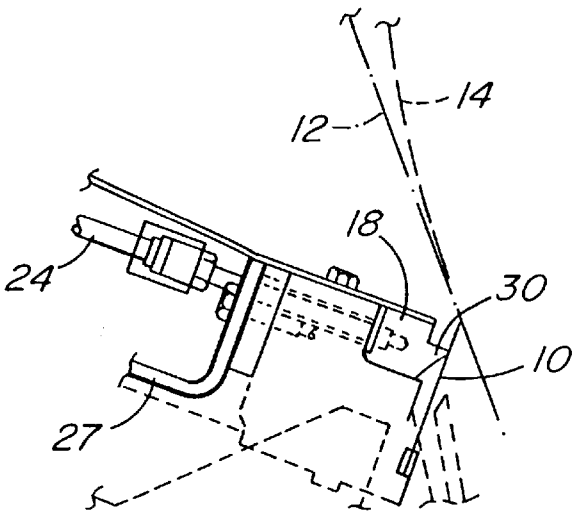
FIG. 5 is a partial side elevational view similar to FIG. 1 showing another embodiment of a flexible backing bar on the coating blade.

A further embodiment is shown in FIG. 5 wherein the flexible backing bar 18 has a rib 30 along the length pressing against the coating blade 10. No inflatable tube 16 is shown and the rib 30 pushes directly onto the blade 10.

The much higher deflection of the flexible bar 18 also requires a smaller applied force. In the example illustrated here, a 600 lbs. force gives a deflection of 0.036 inches at a single point and this provides improved coupling response, i.e., the coupling between the actuators is minimized. The use of aluminum instead of stainless steel improves the effect of flexibility of a bar by a factor of between 4 and 5.

Various changes may be made to the embodiments shown herein without departing from the scope of the present invention which is limited only by the following claims.

What is claimed is:

1. A coat weight control system for applying a specified force profile on a coating blade, the system comprising:

a flexible elongated backing bar for applying a load at an edge thereof to the coating blade from a plurality of actuators applying forces to the bar at spaced apart actuator locations along an opposite edge of the bar, the bar having a plurality of keyhole slots therein spaced along the opposite edge between the actuator locations; and at least one of the keyhole slots comprising an opening therethrough which is spaced away from the opposite edge, and a connecting portion in communication with the opening, and the opening is enlarged relative to the connecting portion and wherein the connecting portion extends to the opposite edge of the backing bar providing greater flexibility to the bar while still retaining rigidity.

2. The coat weight control system according to claim 1 wherein the bar is made of a high yield strength low modulus material.

3. The coat weight control system according to claim 2 wherein the material is a high strength aircraft aluminum with a yield stress of at least about 72,000 psi and an elastic modulus of at least about $10.4\times10^6$ psi.

4. The coat weight control system according to claim 1 wherein the actuator is a low force actuator and provides a maximum loading of about 600 lbs. or less through a single harmonic gear.

5. The coat weight control system according to claim 1 wherein the connecting portion comprises a rectangular portion having a width and having a length extending to the opposite edge of the backing bar at one end of the rectangular portion and extending to the opening at an opposite end.

6. The coat weight control system according to claim 5 wherein the opening comprises a circular portion at the opposite end of the rectangular portion, and the circular portion has a diameter greater than the width of the rectangular portion.

7. A coat weight control system for applying a specified force profile on a coating blade comprising:

a plurality of force actuators spaced apart, the actuators each applying a load;

a flexible backing bar positioned on the coating blade having connections there along to the actuators, the backing bar having a plurality of keyhole slots between the connections, the slots spaced apart along the bar; and at least one of the keyhole slots comprising a rectangular portion and a circular portion at one end of the rectangular portion, and a diameter of the circular portion being greater than a width of the rectangular portion.

8. The coat weight control system according to claim 7 wherein the slots are evenly spaced apart along the bar.

9. The coat weight control system according to claim 8 wherein the slots are evenly spaced apart between the connections on the bar.

10. The coat weight control system according to claim 7 wherein the bar has a groove therein for holding an inflatable tube between the bar and the blade.

11. The coat weight control system according to claim 7 wherein the bar has a ridge on a side opposite the connections to press against the coating blade.

12. The coat weight control system according to claim 7 wherein the actuators each apply a specified load to form the specified force profile on the coating blade.

13. The coat weight control system according to claim 7 wherein there are at least two keyhole slots between a pair of adjacent actuators.

* * * * *